US009403135B2

(12) United States Patent
Cutting

(10) Patent No.: US 9,403,135 B2
(45) Date of Patent: Aug. 2, 2016

(54) MIXING CONTAINER AND MIXING SYSTEM

(71) Applicant: Sartorius Stedim North America Inc., Bohemia, NY (US)

(72) Inventor: Jonathan Cutting, East Setauket, NY (US)

(73) Assignee: Sartorius Stedim North America Inc., Bohemia, NY (US)

( * ) Notice: Subject to any disclaimer, the term of this patent is extended or adjusted under 35 U.S.C. 154(b) by 64 days.

(21) Appl. No.: 14/218,196

(22) Filed: Mar. 18, 2014

(65) Prior Publication Data

US 2015/0265985 A1 Sep. 24, 2015

(51) Int. Cl.

| | |
|---|---|
| ***B01F 13/08*** | (2006.01) |
| ***B01F 3/12*** | (2006.01) |
| ***B01F 11/00*** | (2006.01) |
| ***B01F 11/04*** | (2006.01) |
| ***B01F 15/00*** | (2006.01) |

(52) U.S. Cl.

CPC ..... *B01F 13/0827* (2013.01); *B01F 3/12* (2013.01); *B01F 11/0091* (2013.01); *B01F 11/04* (2013.01); *B01F 13/0872* (2013.01); *B01F 15/0085* (2013.01)

(58) Field of Classification Search

CPC ..... B01F 13/0827
USPC ..... 366/118, 273–275
See application file for complete search history.

(56) References Cited

U.S. PATENT DOCUMENTS

| | | | | | |
|---|---|---|---|---|---|
| 1,242,493 | A * | 10/1917 | Stringham | B01F 13/0827 | 310/211 |
| 2,184,152 | A * | 12/1939 | Saffir | B65D 81/3277 | 206/222 |
| 2,499,203 | A * | 2/1950 | Warren | B01F 11/0071 | 366/275 |
| 2,543,818 | A * | 3/1951 | Wilcox | A47J 43/044 | 366/113 |
| 3,304,449 | A * | 2/1967 | Pohlman | B06B 1/045 | 366/118 |
| 4,793,714 | A * | 12/1988 | Gruber | B01F 3/04978 | 261/122.1 |
| 5,078,504 | A * | 1/1992 | Landa | B01F 3/0819 | 366/118 |
| 6,322,240 | B1 * | 11/2001 | Omasa | B01F 11/0082 | 366/118 |
| 9,121,526 | B2 * | 9/2015 | Giridhar | F16K 99/0015 | |
| 2003/0198406 | A1 * | 10/2003 | Bibbo | B01F 15/0263 | 338/41 |
| 2010/0246317 | A1 * | 9/2010 | Wilson | A01J 5/0132 | 366/142 |

* cited by examiner

*Primary Examiner* — David Sorkin
(74) *Attorney, Agent, or Firm* — Gerald E. Hespos; Michael J. Porco; Matthew T. Hespos

(57) ABSTRACT

A mixing container has a wall enclosing a mixing volume, an anchor fixed at the wall of the mixing container inside the mixing volume, and at least one mixing plate movably mounted to the anchor to allow a relative movement of the at least one mixing plate along a stir direction perpendicular to the extension of the mixing plate. Each of the at least one mixing plates is provided with at least one magnet.

15 Claims, 6 Drawing Sheets

MIXING CONTAINER AND MIXING SYSTEM

BACKGROUND

1. Field of the Invention

The invention relates to a mixing container and a mixing system.

2. Description of the Related Art

The pharmaceutical industry has a need for a low cost single-use mixing technology that operates over a large scale range of container volume, for example for containers from 3 liters volume to 3000 liters volume. The mixing technology should be capable to mix two or more liquids or at least one solid with at least one liquid. Because disposable containers are preferred in various applications the mixing container should be easy and inexpensive to manufacture and should perform a reliable mixing operation. Additionally, because the material to be mixed has high purity requirements, the mixing technology should be ultraclean, i.e. should not generate particulates or create a risk of leakage of fluid through seals.

SUMMARY OF THE INVENTION

One aspect of the invention relates to a mixing container comprising a wall enclosing a mixing volume, an anchor fixed at the wall of the mixing container inside the mixing volume, and at least one mixing plate movably mounted to the anchor to allow a relative movement of the at least one mixing plate along a stir direction having a component perpendicular to the extension of the mixing plate. Each of the at least one mixing plate is provided with at least one magnetic device.

Herein "at least one mixing plate movably mounted to the anchor" is synonymous with a connection between the mixing plate and the anchor that allows a movement of the mixing plate relative to the anchor, including, but not limited to a hinge, flexure material, a mechanical linkage or by pivotally mounting the mixing plate to the anchor.

The mixing volume may be substantially identical to the volume of the container.

Alternatively, the container may be partially filled with a gas, i.e. may contain a headspace, to provide a wider range of working volumes or to provide stabilization of the liquid material (e.g. with an inert gas such as nitrogen).

The anchor can be mounted from the inside of the mixing container to the wall. The anchor is not able to move laterally and/or rotatably relative to the part of the wall surrounding the anchor. Thus, the anchor is not a movable element.

One or more mixing plates are movably, preferably pivotally, mounted to the anchor. The mounting may be provided by means of a hinge or a flexible region of the mixing plate and/or the anchor allowing a relative movement of each mixing plate along a stir direction perpendicular to the extension of the mixing plate. The mixing plate has generally a lateral extension along two dimensions which is much larger than the thickness of the mixing plate. The thickness direction is generally identical to the stir direction.

The mixing or stirring of a liquid and/or solid in the mixing container is performed by vibrating the mixing plates. In order to actuate the at least one mixing plate, each mixing plate is provided with at least one magnetic device, such as a piece of ferromagnetic material (for example steel), a permanent magnet, a superconducting magnet or an electromagnet. Thus, the mixing plate can be actuated by applying a variant external magnetic field to the mixing container, preferably near the mixing plate. In case the external magnetic field is time variant, the magnetic device and thus the mixing plate can be induced to perform a vibrating motion, which is beneficial for performing the mixing operation.

Optionally, each of the at least one mixing plates is mounted to the anchor by means of a flexure hinge. The anchor and the at least one mixing plate may be made of the same material and/or made as one piece. As example, the anchor and the at least one mixing plate can be made of thermoplastic resin, preferably by injection molding. In this case anchor, mixing plate and the connecting flexure hinge can be easily formed.

As a further option, each of the at least one mixing plates comprises a proximal end movably, preferably pivotally, mounted to the anchor and a distal end comprising the at least one magnetic device. The flexure hinge may be located at the proximal end of the at least one mixing plate.

In an alternative embodiment, each of the at least one mixing plates comprises a proximal end movably, preferably pivotally, mounted to the anchor, a distal end and a magnetic device, wherein the magnetic device is located in a part of the mixing plate between the proximal end and the distal end. Preferably, the magnetic device is located in the middle part of the mixing plate between the proximal end and the distal end.

These embodiments offer the advantage that the magnetic actuator positioned outside of the container and containing the magnets of the drive unit (which interact with the corresponding magnets of the magnetic devices of the mixing plates inside the container) can have a smaller, more space-saving size than a larger magnetic actuator adapted to interact with magnetic devices which are placed at the distal ends of the mixing plates.

Optionally, the at least one magnetic device is located at a side or a surface of the mixing plate directed to the wall of the mixing container. In other words the side or surface of the mixing plate comprising the magnetic device is directed away from the center of the mixing volume or to the outside of the container.

According to another embodiment of the invention, the magnetic device is embedded in the interior of the mixing plate, in case the magnetic device is made of a material which is not compatible with the contents to be mixed in the mixing container.

In all of the aforementioned embodiments, the gap between the mixing plate, respectively the magnetic device, and the wall of the container should be minimized in order to maximize the coupling between the at least one magnetic device of the mixing plate and a corresponding magnetic device outside the container. However, an undersized gap undesirably limits the travel distance of the mixing plate, hence a gap in the range of 5 mm to 10 mm is preferred.

In an embodiment of the invention, the anchor is fixed and the mixing plates are set in vibrating motion by application of an external driving magnetic field. However, it is also possible for an internal magnetic field in the mixing plates (e.g. by an electromagnet disposed in each mixing plate and a fixed permanent magnet disposed outside the container) to create an internal driving magnetic field.

As an option the wall of the mixing container comprises a flexible material. Generally the wall can be formed as a flexible bag, particularly when used as a disposable bioreactor, e.g. for mixing and for culturing organisms. As a further option the wall can be formed as a rigid container. In both cases the wall can be at least partially made of at least one of plastic, metal such as (stainless) steel, and glass. The wall can be made of a gamma-ray sterilizable polymer, particularly when used as a bioreactor.

Anchor and wall are assembled in a fluid (liquid and/or gas) tight manner. As an option the anchor is welded to the wall of the mixing container. Particularly, in case the anchor and the wall are made of the same or different thermoplastic polymers the welding of anchor and wall is a convenient way to mount both together in a fluid tight manner.

Optionally, the mixing container comprises a plurality of mixing plates and the magnetic devices of neighbouring mixing plates are of opposite orientation. For example, two, three, four, five, six, seven, eight or more mixing plates may be connected to the anchor. The mixing plates can be identical or different from each other.

Each mixing plate can comprise one or more mixing orifices, i.e. holes through the mixing plate in order to allow a fluid flow from one side of the mixing plate to the other. Optionally, each mixing orifice is a tapered orifice through which a net fluid flow can be generated when the orifice moves up and down during the vibrating motion of the mixing plate which leads to a better mixing result. The flow of fluid is a net fluid flow caused by flow in one direction being higher than flow in the opposite direction. The facilities provided in the mixing-plate openings can be tapered upwards or downwards, although a combination is possible. In other words all tapered orifices can be oriented in one direction or the tapered orifices may be partially directed in one direction and partially in the opposite direction. The orifices can have other geometries, such as orifices with round entrances or ellipse entrances or diffuser nozzles. In order to perform the mixing each of the mixing plates is moved periodically along and against the stir direction, which extend substantially perpendicular to the areal extension of the mixing plate. In other words, the mixing plates perform longitudinal vibrations along the stir direction.

The invention also relates to a mixing system comprising the above-described mixing container, a container receptacle adapted to at least partially receive the mixing container, and a magnetic actuator comprising at least one magnetic device adapted to induce a time-variant magnetic field which actuates the at least one magnetic device of the mixing container in order to move the corresponding mixing plate along the stir direction.

Optionally, the magnetic actuator comprises a turntable to which the at least one magnetic device is mounted. Particularly, the arrangement pattern of the magnetic devices mounted to the turntable can be congruent or identical to the pattern of the magnetic devices of the mixing plates mounted to the anchor. As an option, the turntable comprises a plurality of magnetic devices wherein neighbouring magnetic devices are of opposite orientation. Optionally, the stir direction is substantially parallel to the axis of rotation of the turntable.

In a particularly preferred embodiment the magnetic devices of neighboring mixing plates have opposite polarity, i.e. N, S, N, S, N, etc., whereas the turntable comprises a plurality of magnetic devices wherein neighboring magnetic devices are of the same orientation, i.e. N, N, N, N, N, etc. or S, S, S, S, S, etc. In other words, the magnetic devices of the turntable have all the same polarity. By means of this embodiment half of the mixing plates are moving in one direction (for example upward movement), while the other half of the mixing plates are moving in the opposite direction (for example downward movement). This arrangement pattern of the magnetic devices of the mixing plates and of the turntable creates a balanced movement of the mixing plates which avoids potentially damaging reaction forces which may be caused by a unbalanced movement of the mixing plates wherein all mixing plates move in the same direction simultaneously.

The invention further relates to a mixing container comprising a wall enclosing a mixing volume, an anchor fixed at the wall of the mixing container inside the mixing volume, and at least one mixing plate movably mounted to the anchor to allow a relative movement of the at least one mixing plate along a stir direction perpendicular to the extension of the mixing plate. Each of the at least one mixing plates is provided with at least one mixing orifice and wherein each of the at least one mixing plates is provided with at least one magnetic device.

Further features and advantages are described with references to the figures.

DETAILED DESCRIPTION OF THE PREFERRED EMBODIMENTS

Figure 1:
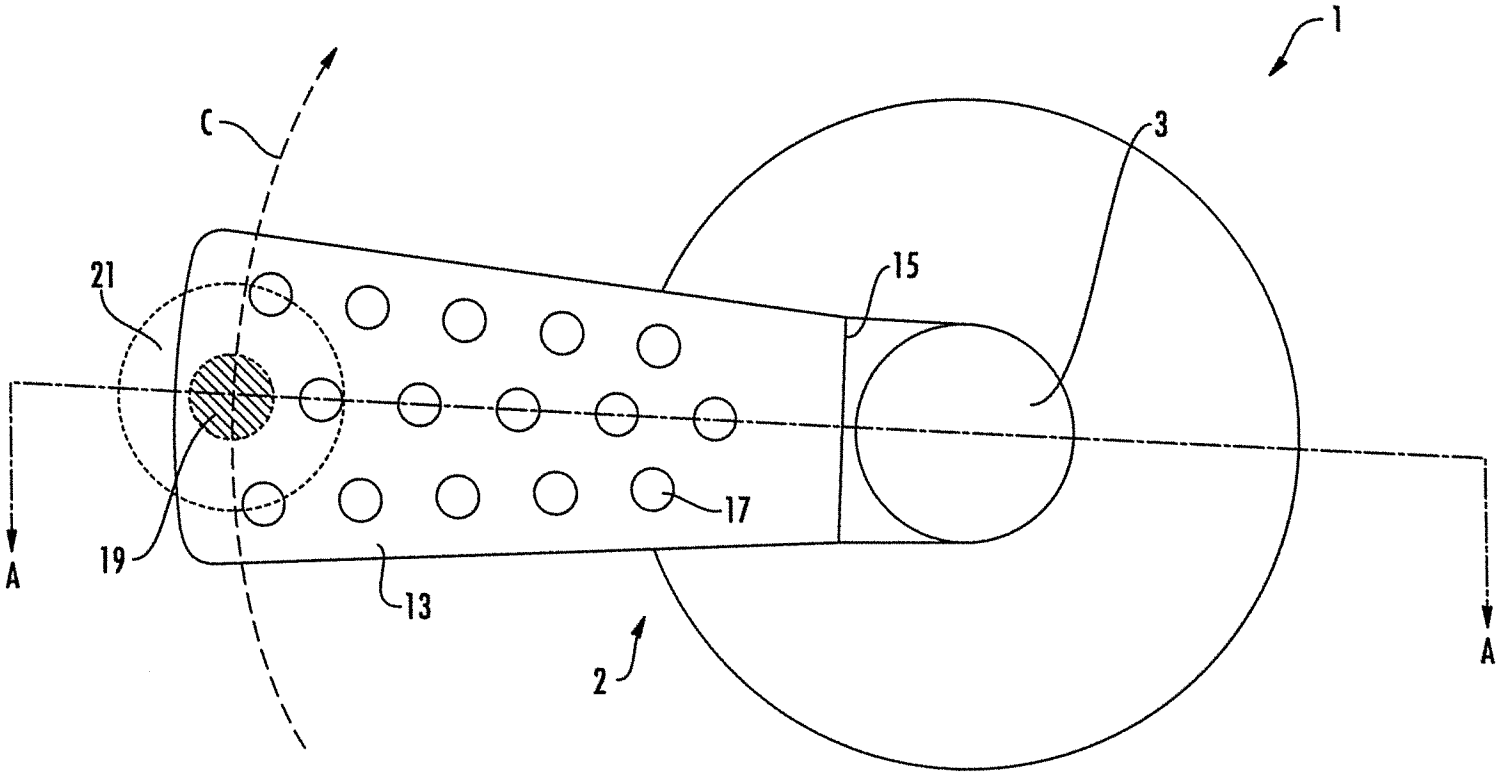
FIG. 1 shows a top view of an anchor with a mixing plate connected thereto.
Figure 2:
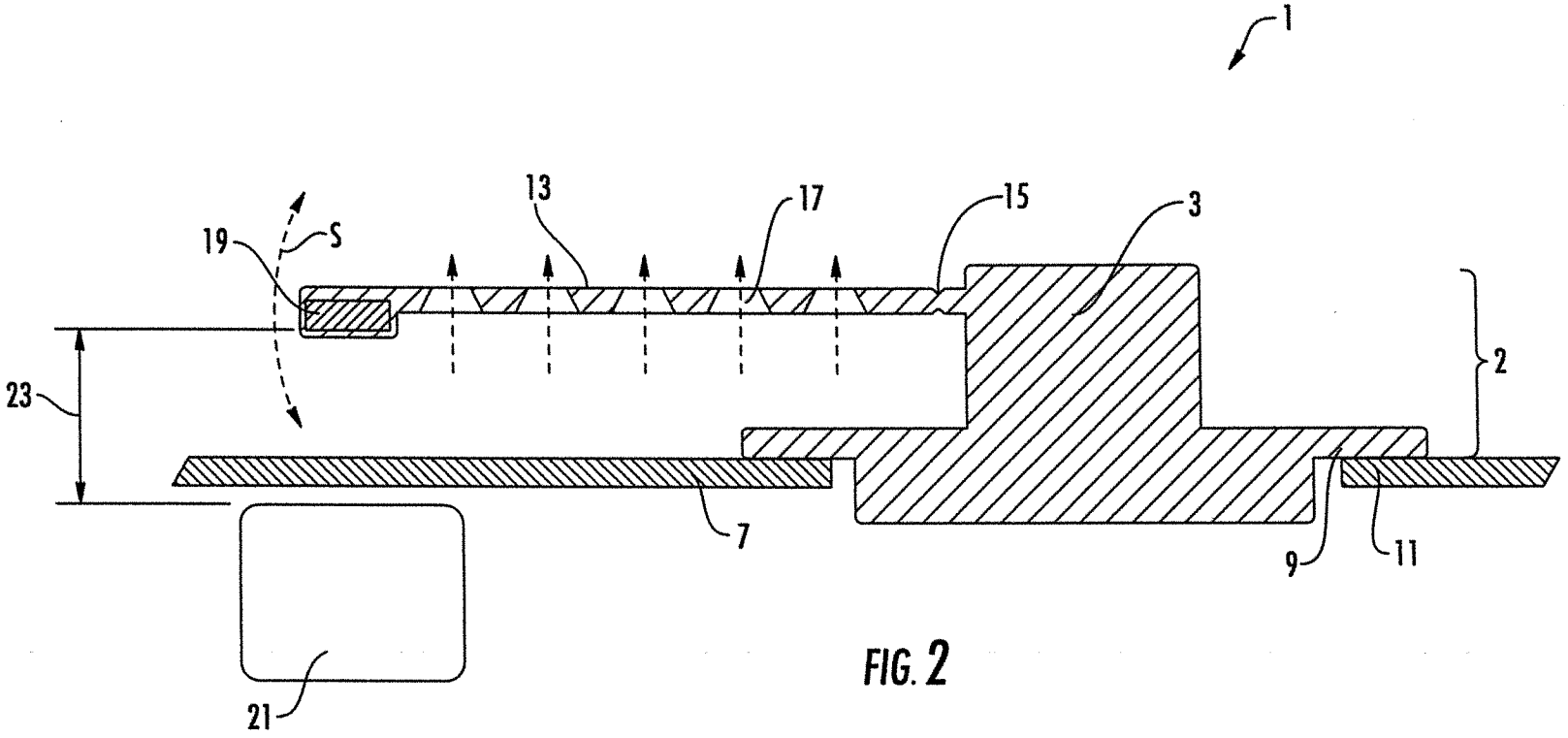
FIG. 2 shows a section view to the embodiment shown in FIG. 1.

FIGS. 1 and 2 show an embodiment of a mixing container 1. While FIG. 1 shows a top view of the mixing container 1, FIG. 2 shows a section view along the section line 2-2 shown in FIG. 1. As shown in FIGS. 1 and 2, the mixing container 1 includes a mixing head 2 comprising an anchor 3 with at least one mixing plate 13 connected thereto.

The mixing container 1 may be a single use container. The anchor 3 is attached to the wall 7 of the mixing container 1 via a welding flange 9 of the anchor 3 which is welded to a welding zone 11 of the wall 7. One or more (not shown) mixing plates 13 are movably, preferably pivotally connected to the anchor 3 via a flexure hinge 15 (shown in FIG. 2). The wall 7 may be rigid or flexible, such as a bag. As an advantage a flexible, bag-like wall 7 allows to fold and collapse the mixing container 1 prior to use and after use for disposal.

Each mixing plate 13 is formed as a planar plate comprising one or more mixing orifices 17, which can have a tapered shape, for example a cone shape, as shown for example in the figures. This allows the generation of a net fluid flow through the mixing orifices 17 leading to an improved mixing result.

The mixing plate 13 contains one or more embedded magnetic devices or magnets 19, which can be for example formed of a NdFeB disc made of an alloy of neodynium, iron and boron and which are used as drivers. A ferromagnetic material such as ferritic stainless steel could be substituted for the permanent magnet 19 to reduce costs. However, the driving force would be reduced by approximately the half. The magnets 19 may also be mounted to the surface of the mixing plate 13. Alternatively, the magnets 19 can be embedded in the interior of the mixing plate 13.

The mixing plate can be actuated by applying an external magnetic field to the mixing container 1, preferably near one or more magnets 19 of the one or more mixing plates 13. By varying the external magnetic field over the time the magnets 19 and thus the mixing plates 13 are induced to perform a vibration motion along a stir direction S. A magnetic actuator comprising at least one magnetic device or magnet 21 can be located near the mixing container 1 in order to induce a time-variant magnetic field which actuates the at least one magnet 19 of the mixing plate 13, and thus, cause a vibration of the mixing plate 13 along the stir direction S.

The transient actuation of the magnets 19 can be obtained by using a magnet 21 providing a variable magnetic field, such as an electromagnet, or by moving the position of magnet 21. FIG. 1 indicates that magnet 21 is moving along a circular path C around anchor 3 in order to periodically actuate magnet 19. In order to maximize the actuating force applied to magnet 19 by magnet 21 the gap 23 or distance between both should be minimized. For example the distance may range between 5 mm and 10 mm. In other words, the permanent magnet 19 should be located as close to the wall 7 of the mixing container 1 as is possible without causing collisions between the mixing plate 13 and the wall 7. The permanent magnet 19 need not to be in the plane of the mixing plate 13. It may be advantageous to have a clearance between the mixing plate 13 and the wall 7, so that the net fluid flow induced by the motion of the mixing plate 13 is not hindered.

The orifices 17 located in the mixing plate 13 need not be of circular shape, but they may also have the shape of a slot or any other convenient shape. Each mixing plate 13 may be connected to the anchor 3 at one or more locations via linkages or hinges 15. These linkages may be rigid, thereby creating a bending cantilever beam, or flexible, such as a living hinge. The motion of the mixing plate 13 is determined by the geometry, material properties, fluid properties, and the temporal variation of the external magnetic field. The anchor 3 and the at least one mixing plate 13 may be formed integrally, e.g. by injection molding, from a polymeric material suitable for product contact, and thus, forming a mixing head 2. The mixing head 2 is ideally contoured such that the top surface is smooth and does not have any sharp edges that could potentially damage the opposite interior wall 7 of the mixing container 1 when the mixing container 1 is collapsed.

Figure 3C:
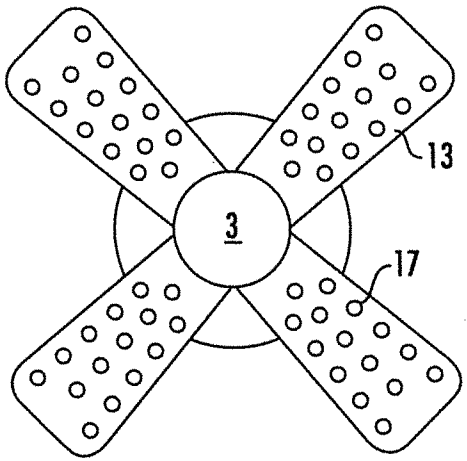
FIG. 3(*a*), 3(*b*) and FIG. 3(*c*) show various arrangements of mixing plates.
Figure 3B:
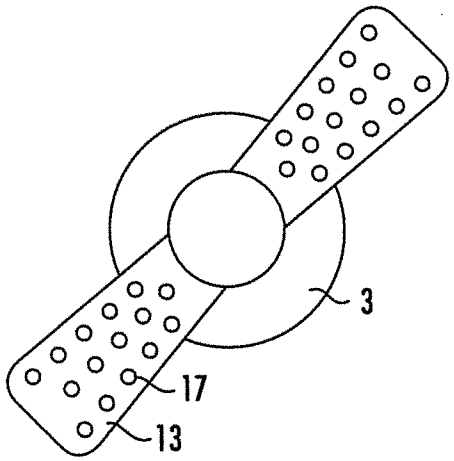
Figure 3A:
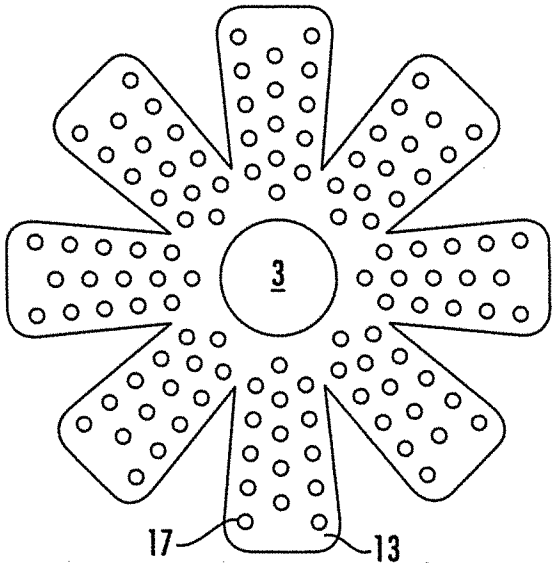

FIGS. 3(*a*), 3(*b*) and 3(*c*) show various arrangements of mixing plates 13. As shown in FIG. 3(*a*) eight mixing plates 13 could be assembled to or formed integrally with the anchor 3. All mixing plates 13 have an identical pattern of orifices 17. As shown in FIG. 3(*b*), it is also possible to perform the mixing operation with two mixing plates 13 connected to the anchor 3, or as shown in FIG. 3(*c*), with four mixing plates 13.

Figure 5:
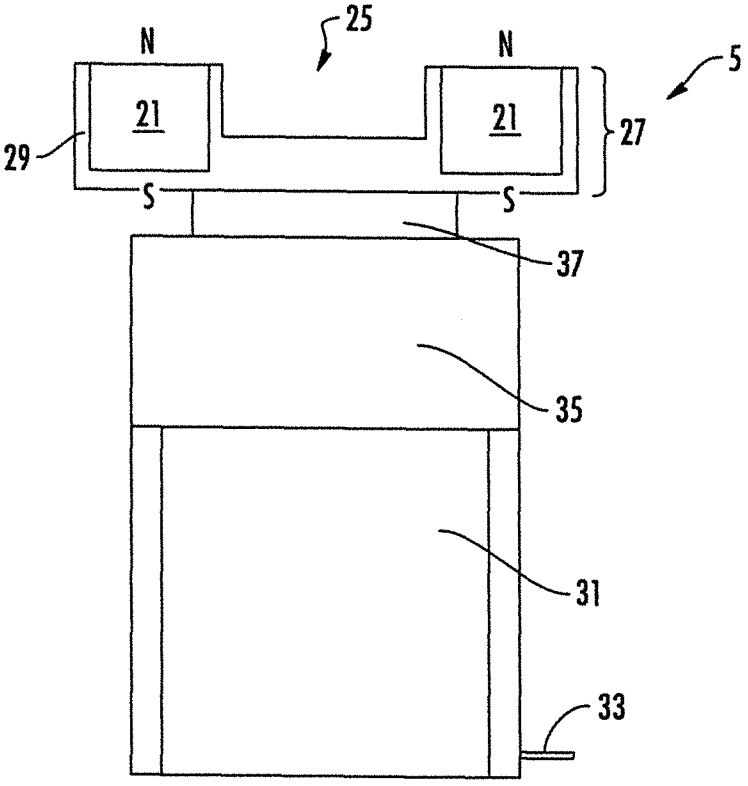
FIG. 5 shows a section view to the mixing system taken along line 5-5 in FIG. 4.
Figure 4:
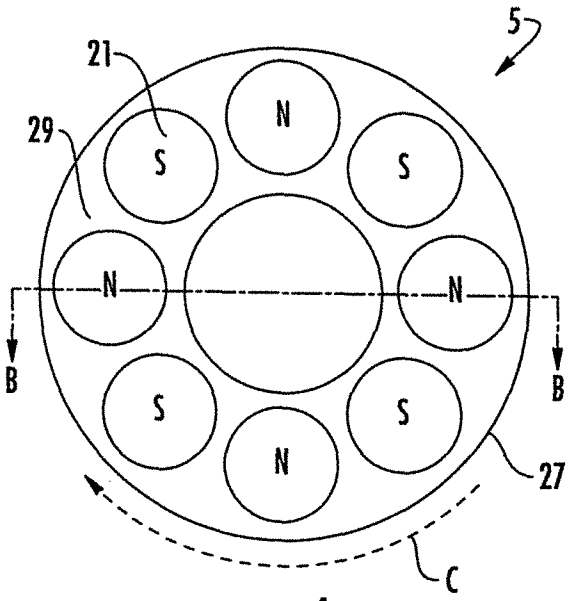
FIG. 4 shows a top view of a mixing system.

FIGS. 4 and 5 show an embodiment of a drive unit 5. While FIG. 4 shows a top view of the drive unit 5, FIG. 5 shows a section view along the section line 5-5 shown in FIG. 4. As shown in FIGS. 4 and 5, the drive unit 5 comprises a container receptacle 25 adapted to at least partially receive the mixing container 1 (shown in FIGS. 1 and 2). The container receptacle 25 may be a flat area adapted to be in mechanical contact and/or magnetic contact with the anchor 3 and/or the wall 7 of the mixing container 1. As an option the mixing container 1 can be placed with its bottom to the container receptacle 25. The term "magnetic contact" describes the case when the wall 7 does not come into touch with the container receptacle 25, but the drive unit 5 is close enough to actuate the magnets 19 of the mixing container 1. Regardless whether mixing container 1 and drive unit 5 are in mechanical or magnetic contact with each other the container receptacle 25 may be formed congruent to a part of the wall 7 including the anchor 3.

The drive unit 5 includes a magnetic actuator 27 comprising at least one magnet 21 adapted to induce a time-variant magnetic field which actuates the at least one magnet 19 of the mixing container 1 in order to move the corresponding mixing plate 13 along the stir direction S.

The magnetic drive unit 5 is external to the mixing container 1 and generates a variable magnetic field for example by motion of a permanent magnet 21 or by variable current through a fixed electromagnet (not shown). The preferred solution is to move one or more permanent magnets 21 in a circular path C that coincides with the position of the permanent magnets 19 embedded in the mixing plates 13. The permanent magnets 21 may be mounted to a turntable 29 and are rotated by means of a conventional rotating motor 31, such as a brushless DC motor 31, powered via a power cord 33. The turntable 29 can be coupled to the motor 31 via a gear 35 and a driving shaft 37.

The permanent magnets 21 can be arranged on the turntable in a way so that neighbouring magnets 21 are of opposite orientation. In other words the magnetic poles of adjacent magnets 21 are opposite—e.g. N, S, N, S, so that the rotation of the motor 31 generates alternating attraction and repulsion forces at each mixing plate 13 as the permanent magnet 21 in the drive unit 5 approaches the permanent magnet 19 embedded in the mixing plate 13. In a preferred embodiment the magnets 19 of neighboring mixing plates 13 have opposite polarity—e.g. N, S, N, S, whereas the magnets 21 of the drive unit 5 all have the same polarity, i.e. N, N, N, N or S, S, S, S, so that a balanced motion of the mixing plates 13 is created, wherein one half of the mixing plates 13 moves upward and the other half of the mixing plates 13 performs a downward motion or vice versa.

Figure 6:
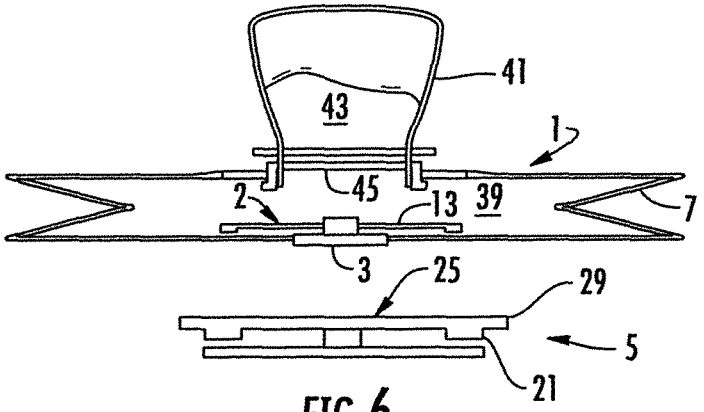
FIG. 6 shows an exploded section view of the whole mixing system.
Figure 7:
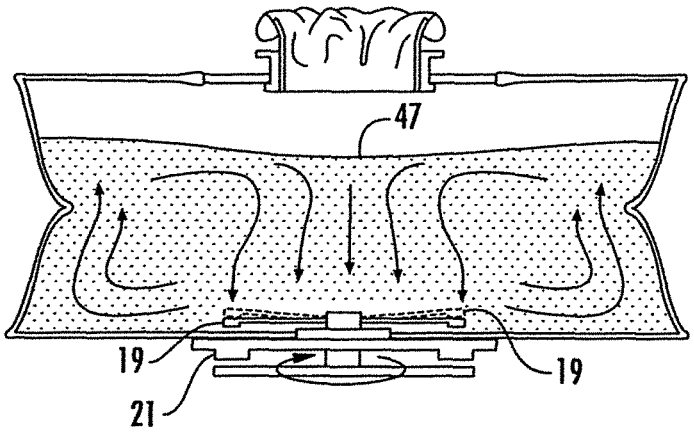
FIG. 7 shows a further section view to the mixing system shown in FIG. 6 when in use.

FIGS. 6 and 7 show section views of the whole mixing system shown in FIGS. 1 to 5. FIG. 6 shows the drive unit 5 and the mixing container 1 having a partially flexible wall 7 in a collapsed state, so that the mixing volume 39 inside the container 1 is minimized. Attached to the mixing container 1 is a reservoir 41 containing a liquid or solid substance 43 to be mixed with a solvent. The reservoir is separated from the mixing volume 39 by means of a seal 45, particularly a sterile, hermetic seal.

As shown in FIG. 7 the mixing container 1 is expanded, the seal 45 is broken to release substance 43 from the reservoir 41 into the mixing container 1 and a solvent is added. The anchor 3 with the mixing plates 13 is coupled to the drive unit 5 and the drive unit 5 is activated in order to perform the mixing operation.

The motion of each orifice 17 (as shown in FIGS. 1 to 3) in the mixing plate 13 is adequate to generate a net flow of liquid inside the single-use mixing container 1. The orifices 17 may be arranged in either direction. For low level applications a downward direction is preferred to avoid splashing at the surface 47 of the liquid. Although flow is primarily axial, the relative movement of magnets 19 in the mixing plates 13 combined with the flexibility of the linkages creates a wobble. This wobble may be exploited to generate fluid motion with a nonzero radial component. The drive unit 5 is fully isolated from the container and there are no seals or bearings in contact with the product inside the single-use mixing container 1. The drive unit 5, particularly the container receptacle 25, may have a geometry which precisely locates the anchor 3 of the mixing container with respect to the moving magnets 19.

There are several parameters which may be adjusted in design or in operation to achieve a target performance. The number, size, spacing, and polarity of the magnets 19, 21 in the mixing plates 13 and the drive unit 5 may be adjusted to change the driving power. The power, speed, and gear ratio of the motor 31 may be adjusted to change the mixing power. It may be advantageous to operate near the resonant frequency of the mixing plate 13 to maximize the amplitude of response of the mixing plate 13.

The geometry of the mixing orifices 17 (e.g. diameter, angle, depth) may also be optimized to maximize mixing performance.

Figure 8A:
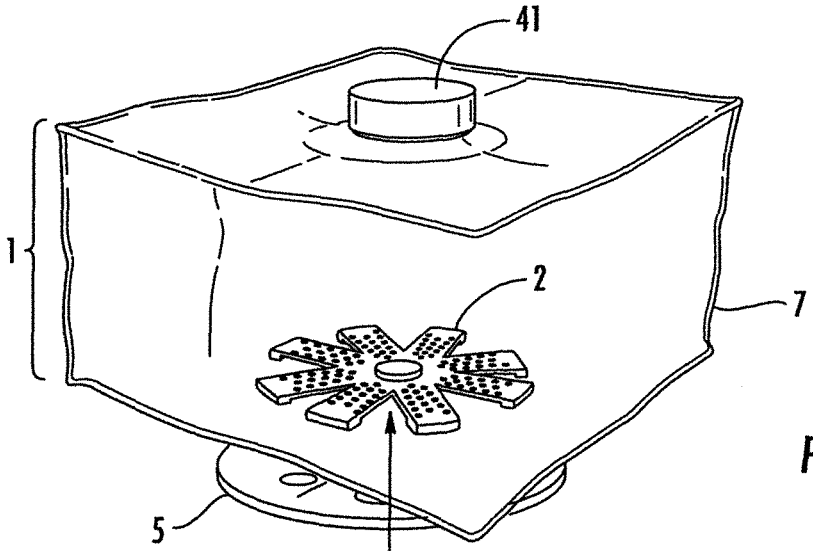
FIGS. 8(*a*) and 8(*b*) show perspective views of the mixing system while FIG. 8(*c*) is a side elevational view of mixing plate.
Figure 8B:
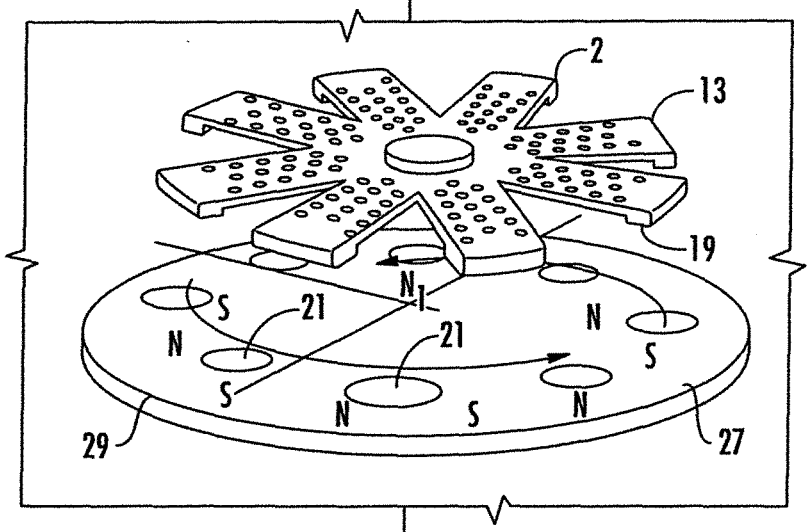
Figure 8C:
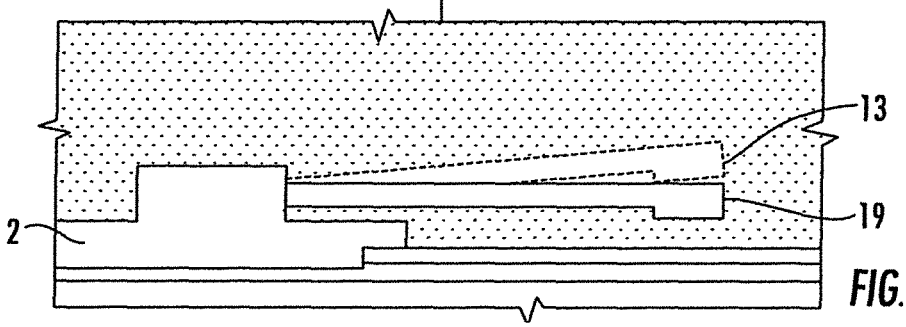

FIG. 8(*a*) shows a perspective view of the mixing system, wherein the mixing container 1 is in an expanded state. FIG. 8(*b*) shows the arrangement of mixing head 2 relative to the magnetic actuator 27. FIG. 8(*c*) shows a detailed view of a wobbling mixing plate 13. The elements of FIGS. 8(*a*), 8(*b*) and 8(*c*) are identical with the elements shown in the previous figure, and thus, are labelled with identical reference signs. The mixing system is operated as described with reference to FIGS. 6 and 7 above.

LIST OF REFERENCE SIGNS

1 mixing container
2 mixing head
3 anchor
5 drive unit
7 wall of the mixing container
9 welding flange of the anchor
11 welding zone of the wall
13 mixing plate
15 flexure hinge
17 mixing orifice
19 magnet of the mixing plate
21 magnet of the drive unit
23 gap
25 container receptacle
27 magnetic actuator
29 turntable
31 motor
33 power cord
35 gear
37 driving shaft
39 mixing volume
41 reservoir
43 substance
45 seal
47 surface of the liquid
S stir direction
C circular path around the anchor

What is claimed is:

1. A mixing system comprising:

a mixing container having a wall enclosing a mixing volume, an anchor fixed at the wall of the mixing container inside the mixing volume, at least one mixing plate pivotably mounted to the anchor to allow a relative movement of the at least one mixing plate along a stir direction having a component perpendicular to the extension of the mixing plate, each of the at least one mixing plates being provided with at least one magnetic device that is mounted to a surface of the at least one mixing plate or that is embedded in the interior of the at least one mixing plate, a container receptacle configured to at least partially receive the mixing container, and a magnetic actuator comprising at least one magnetic device adapted to induce a time-variant magnetic field that actuates the at least one magnetic device of the mixing container in order to move the corresponding mixing plate along the stir direction and a turntable to which the at least one magnetic device is mounted.

2. The mixing system of claim 1, wherein each of the at least one mixing plates is mounted to the anchor by means of a flexure hinge.

3. The mixing system of claim 1, wherein each of the at least one mixing plates comprises a proximal end movably mounted to the anchor and a distal end comprising the at least one magnetic device.

4. The mixing system of claim 1, wherein each of the at least one mixing plates comprises a proximal end mounted to the anchor, a distal end and a magnetic device, wherein the magnetic device is located in a part of the mixing plate between the proximal end and the distal end.

5. The mixing system of claim 1, wherein the at least one magnetic device is located at a side or a surface of the mixing plate directed to the wall of the mixing container.

6. The mixing system of claim 1, wherein the wall of the mixing container comprises a flexible material.

7. The mixing system of claim 1, wherein the anchor is welded to the wall of the container.

8. The mixing system of claim 1, wherein the mixing container comprises a plurality of the mixing plates and wherein the magnetic devices of neighbouring mixing plates are of opposite orientation.

9. The mixing system of claim 1, wherein each of the at least one mixing plates is provided with at least one mixing orifice.

10. The mixing system of claim 9, wherein each mixing orifice is a tapered orifice.

11. The mixing system of claim 1, wherein the magnetic device is a permanent magnet, an electromagnet or a superconducting magnet or wherein the magnetic device is made of a ferromagnetic material.

12. The mixing system of claim 1, wherein the turntable comprises a plurality of magnetic devices wherein neighbouring magnetic devices are of opposite orientation.

13. The mixing system of claim 1, wherein the magnetic devices of neighboring mixing plates have opposite polarity, whereas the turntable comprises a plurality of magnetic devices which have all the same polarity.

14. The mixing system of claim 1, wherein the stir direction is substantially parallel to an axis of rotation of the turntable.

15. The mixing system of claim 1, wherein the magnetic device of the magnetic actuator is a permanent magnet, an electromagnet or a superconducting magnet or is made of a ferromagnetic material.

* * * * *